US009458645B1

(12) United States Patent
King et al.

(10) Patent No.: US 9,458,645 B1
(45) Date of Patent: Oct. 4, 2016

(54) MODULAR FENCE KIT

(71) Applicants: Marc J. King, Las Vegas, NV (US); Rubie Jewel King, Las Vegas, NV (US)

(72) Inventors: Marc J. King, Las Vegas, NV (US); Rubie Jewel King, Las Vegas, NV (US)

( * ) Notice: Subject to any disclaimer, the term of this patent is extended or adjusted under 35 U.S.C. 154(b) by 139 days.

(21) Appl. No.: 14/561,429

(22) Filed: Dec. 5, 2014

Related U.S. Application Data

(60) Provisional application No. 61/963,691, filed on Dec. 12, 2013.

(51) Int. Cl.
*E04H 17/16* (2006.01)
*E04H 17/14* (2006.01)
*E04H 17/22* (2006.01)

(52) U.S. Cl.
CPC ..... *E04H 17/14* (2013.01); *E04H 17/22* (2013.01); *E04H 17/16* (2013.01)

(58) Field of Classification Search
CPC ..... E04H 17/14; E04H 17/16; E04H 17/18; E04H 17/22; E06B 11/02
USPC ..... 256/11, 24, 26, 27, 73
See application file for complete search history.

(56) References Cited

U.S. PATENT DOCUMENTS 3,815,877 A * 6/1974 Turner ..... E04H 17/18 256/24
4,809,955 A 3/1989 Veilleux
5,100,108 A * 3/1992 Schultz ..... E04H 3/12 256/23
5,402,988 A * 4/1995 Eisele ..... E01F 13/022 160/351
5,460,353 A * 10/1995 Rittenhouse ..... A63B 71/028 160/135
5,560,588 A 10/1996 Hilliard
5,593,141 A * 1/1997 Cain ..... A01K 1/0017 256/26
5,702,090 A 12/1997 Edgman
5,718,414 A * 2/1998 Deloach ..... E04H 17/163 256/24
5,813,662 A * 9/1998 Langkruis ..... E04H 12/2246 160/135
6,789,786 B1 * 9/2004 Schatzberg ..... E04H 4/06 256/25
7,377,490 B1 * 5/2008 Khosravian ..... E01F 13/028 119/416
7,461,489 B2 * 12/2008 Herbertsson ..... E04H 17/165 256/22
7,500,655 B1 * 3/2009 Smith ..... E06B 11/02 256/27
7,686,283 B2 * 3/2010 Marchio ..... E06B 11/02 256/11
8,387,955 B2 * 3/2013 Ptacek ..... E04H 17/163 256/24

FOREIGN PATENT DOCUMENTS

NL 1002257 C2 * 8/1997 ..... E04H 17/1443

* cited by examiner

*Primary Examiner* — Gregory Binda
*Assistant Examiner* — Nahid Amiri
(74) *Attorney, Agent, or Firm* — Crossley & Stevenson Intellectual Property Law

(57) ABSTRACT

A modular fence kit including at least one pre-formed fencing panel, at least one fence pole removably attached to each of a sidewall of each fencing panel via at least one fastener, such as a clamp, and a base attached to each fence pole. The base is one of a weighted hollow first base body into which a host sleeve locks, a stake into which the fence pole is directly inserted, and a disc atop which the fence pole is attached. The host sleeve supports the fence pole within the first base body. A pair of opposing vertical protrusions, disposed on the outside wall of the host sleeve, lockingly engage a slot within the first base body.

13 Claims, 9 Drawing Sheets

MODULAR FENCE KIT

CROSS-REFERENCE TO RELATED APPLICATIONS

U.S. Provisional Utility application Ser. No. 61/963,691 Filed Dec. 12, 2013

FEDERALLY SPONSORED RESEARCH OR DEVELOPMENT

Not Applicable

INCORPORATION BY REFERENCE OF MATERIAL SUBMITTED ON A COMPACT DISK

Not Applicable

TO ALL WHOM IT MAY CONCERN

Be it known that we, Marc J. King and Rubie Jewel King, both citizens of the United States, have invented new and useful improvements in a modular fence kit as described in this specification. We claim benefit of our U.S. Provisional Application No. 61/963,691 filed on Dec. 12, 2013.

BACKGROUND OF THE INVENTION

Various types of modular fences are known in the prior art. Some of the known modular fences require post hole digging to secure the fence posts into the ground, while other modular fences employ pedestals that are bolted into place to support the fence posts. At least one known modular fence which relies upon interlocking connection keys or protrusions that engage notches to attach the panels together. Another known modular fence provides rails with openings into which edges of panels are inserted and catches in the rails to hold the panels into the rails. Yet another fencing system provides molded plastic post and rails that snap together. However, what is needed is a modular fence kit including includes a host sleeve that locks into each of a plurality of weighted bases with a fence pole being inserted into each host sleeve for support, each weighted base substantially filling a gap between the bottom ends of each pair of fencing panels.

FIELD OF THE INVENTION

The present invention relates to modular fences, and more particularly, to a modular fence kit which includes a host sleeve that locks into each of a plurality of weighted bases with a fence pole being inserted into each host sleeve for support, each weighted base substantially filling a gap between the bottom ends of each pair of fencing panels.

SUMMARY OF THE INVENTION

The general purpose of the present modular fence kit, described subsequently in greater detail, is to provide a modular fence kit which has many novel features that result in a modular fence kit which is not anticipated, rendered obvious, suggested, or even implied by prior art, either alone or in combination thereof.

To accomplish this, the present modular fence kit is devised to provide a portable fence that is easily assembled and disassembled without digging any post holes. The present modular fence kit includes a plurality of pre-formed fencing panels attached together with fasteners, such as clamps that extend from a sidewall of each fencing panel, and fence poles to which the fasteners attach to secure the fencing panels to the fence poles. In addition, a host sleeve is provided to rotatably support each fence pole thus permitting attachment of the fence poles at various angles relative to each other which, in turn, allows the fence poles to be arranged in various configurations, such as in a triangular configuration or a rectangular configuration. Each host sleeve is disposed within a first base body and one of the fence poles fits into the host sleeve. A locking mechanism locks each host sleeve into the respective first base body. Each first base body is weighted with fill material is provided for each fence pole to support each fence pole in a sturdily supported, upright position. The weighted first base bodies are also stackable for transport and storage. A hollow stake is also provided as a second base body for securing a fence pole into a surface. The stake facilitates the installation of a fence using the kit in various types of terrain, including uneven terrain. In addition, a third base body in the form of a disc to which a fence post can be attached.

The present modular fence kit provides both indoor and outdoor fencing, fencing for crowd control, and can be used in a wide variety of environments for a number of uses, including a construction barricade, an office divider, a playpen, a swimming pool barricade, a mobile pen for livestock, a dog run, and a temporary roadblock. Because the present kit permits that installation of a fence quickly, without tools, without post hole digging, and without pouring concrete, labor and materials costs are decreased over permanent fences and the risk of injury and associated liability is reduced. A fence constructed with the present fence, in contrast to a permanent fence, can be disassembled quickly and moved in the event of a natural disaster, such as a hurricane, to prevent damage to the fence and when necessary to mow a lawn without obstruction. The fencing panels, fence poles, and bases can be made of various materials which are selected depending upon the ultimate use and desired aesthetic effect of the fence to be constructed with the kit. The fencing panels are provided in various construction configurations, such as chain-link, privacy, post-and-rail, and wrought iron.

Thus has been broadly outlined the more important features of the present modular fence kit so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
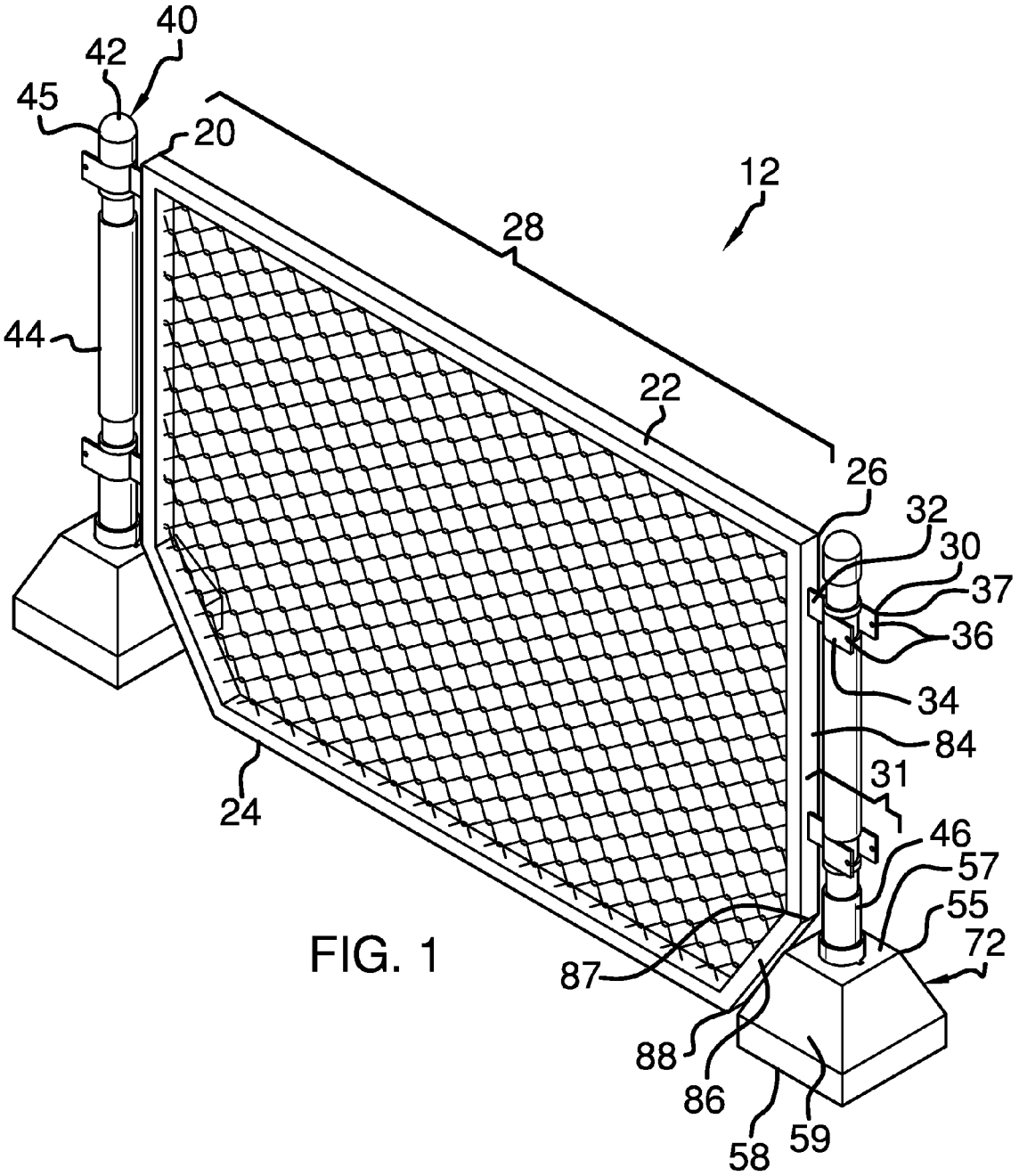
FIG. 1 is an isometric view, showing a first fencing panel attached to a pair of fence posts which are supported by hosts sleeves disposed in first base bodies.

With reference now to the drawings, and in particular FIGS. 1 through 10 thereof, an example of the instant modular fence kit employing the principles and concepts of the present modular fence kit and generally designated by the reference number 12 will be described.

Referring to FIGS. 1 through 10 the present modular fence kit 10 is illustrated. The modular fence kit 12 includes at least one pre-formed fencing panel 20. Each fencing panel 20 has a top end 22, a bottom end 24, and a pair of sidewalls 26 opposite each other between the top end 22 and the bottom end 24. Each fencing panel 20 is one of a first fencing panel 28 and a second fencing panel 29. At least one fastener 31 is provided to attach the fencing panels 20 together. The at least one fastener 31 can be a bracket, for example, or a clamp 30, as illustrated, disposed on each sidewall 26 of the respective fencing panel 20. Each clamp 30 has an arm 32 perpendicularly attached to the respective sidewall 26, a U-shaped mount body 34 attached to the arm 32, and a pair of aligned holes 36 disposed proximal an external edge 37 of the mount body 34. A clevis pin 38 lockingly engages the aligned holes 36 of one of each of the respective clamps 30.

The present kit 12 also includes at least one pair of fence poles 40. Each fence pole 40 has an uppermost end 42, a lowermost end 43, and a continuous external surface 44 between the uppermost end 42 and the lowermost end 43. Each fence pole 40 is one of a first fence pole 45 and a second fence pole 47.

A plurality of bases 55 is provided to support a pair of the fence poles 40. Each base 55 has a top wall 57, a bottom wall 58, and a continuous exterior wall disposed 59 therebetween. The bases 55 include a first base body 72, a second base body 74, and a third base body 76. A vertical cavity 61 is centrally disposed in each of the first base body 72 and the second base body 76 of the bases 55. The cavity 61 has an open top side 63 contiguous with the top wall 57 of the base 55, a closed bottom side 65 proximal the bottom wall 58 of the base 55, and a continuous external wall 67 disposed therebetween.

At least one pair of host sleeves 46 is provided to support each pair of the fence poles 40 within a respective pair of the first base bodies 72. Each host sleeve 46 has an upper end 48, a lower end 49, continuous outside wall 50 therebetween, and a continuous channel 51 between the upper end 48, the lower end 49, and the outside wall 50. The lowermost end 49 of each fence pole 40 rotatably engages the channel 51 of a respective one of the host sleeves 46. A pair of protrusions 53 is vertically disposed on opposite sides of the outside wall 50 of each host sleeve 46 proximal the lower end 49 thereof. One of each fence pole 40 further rotatably engages a respective one of the clamps 30; however, a fastener 31 other than a clamp 30, such as a bracket for example, can be employed to attach the fencing panel and fence pole together. Each host sleeve 46 engages the vertical cavity 46 of a respective one of the first base bodies 72. An amount of fill material 70 is disposed within each of the first base bodies 72 between the top wall 57, the bottom wall 58, the exterior wall 59, and the vertical cavity 61. A pair of vertical slots 80 is disposed within opposite sides of the external wall 67 of the vertical cavity 61 of the first base body 72. Each vertical slot 80 has an upper portion 81 and a lower portion 82 disposed proximal the bottom side 65 of the vertical cavity 61. The lower portion 82 has a wider width than the upper portion 81. Each protrusion 53 on the host sleeve 46 slidingly engages the upper portion 81 of the vertical slot 80 and lockingly engages the lower portion 82 of the vertical slot 80 in a locked position. Upon placement of the protrusions 53 in the locked position, the host sleeve 46 is locked into the respective first base body 72. The protrusions 53 can be placed into the locked position and alternately into an unlocked position.

Each first base body 72 is attachable to a respective one of the first fencing panels 28. On each first fencing panels 28, the bottom end 24 has a shorter length than a length of the top end 22 and is centrally disposed relative the top end 22, each of the sidewalls 26 has a vertical top portion 84 and an inwardly angled bottom portion 86, and the bottom portion 86 is angled from a bottommost end 87 of the vertical top portion 84 toward a respective outer end 88 of the bottom end 24 of the first fencing panel 28. Thus, a gap 91 is disposed between the bottom ends 24 of a pair of adjoining first fencing panels 28. A portion of the exterior wall 59 of each first base body 72 has a same angle as the bottom portion 86. The angle of the portion of the exterior wall 59 of each first base body 72 and a width and a height of each first base body 72 substantially fills the respective gap 91 between each respective pair of adjoining first fencing panels 28.

Each of the second and third base bodies 74, 76 is attachable to a respective one of the second fencing panels 29 in which the bottom end 24 of each fencing panel has a same width as a length of the top end 22 and the sidewalls 26 are perpendicular to each of the top and bottom ends 22, 24. The second base body 74 is a hollow stake. The third base body 76 is a disc to which the lowermost end 43 of a respective fence pole 40 is directly attached to the top wall 57.

Figure 2:
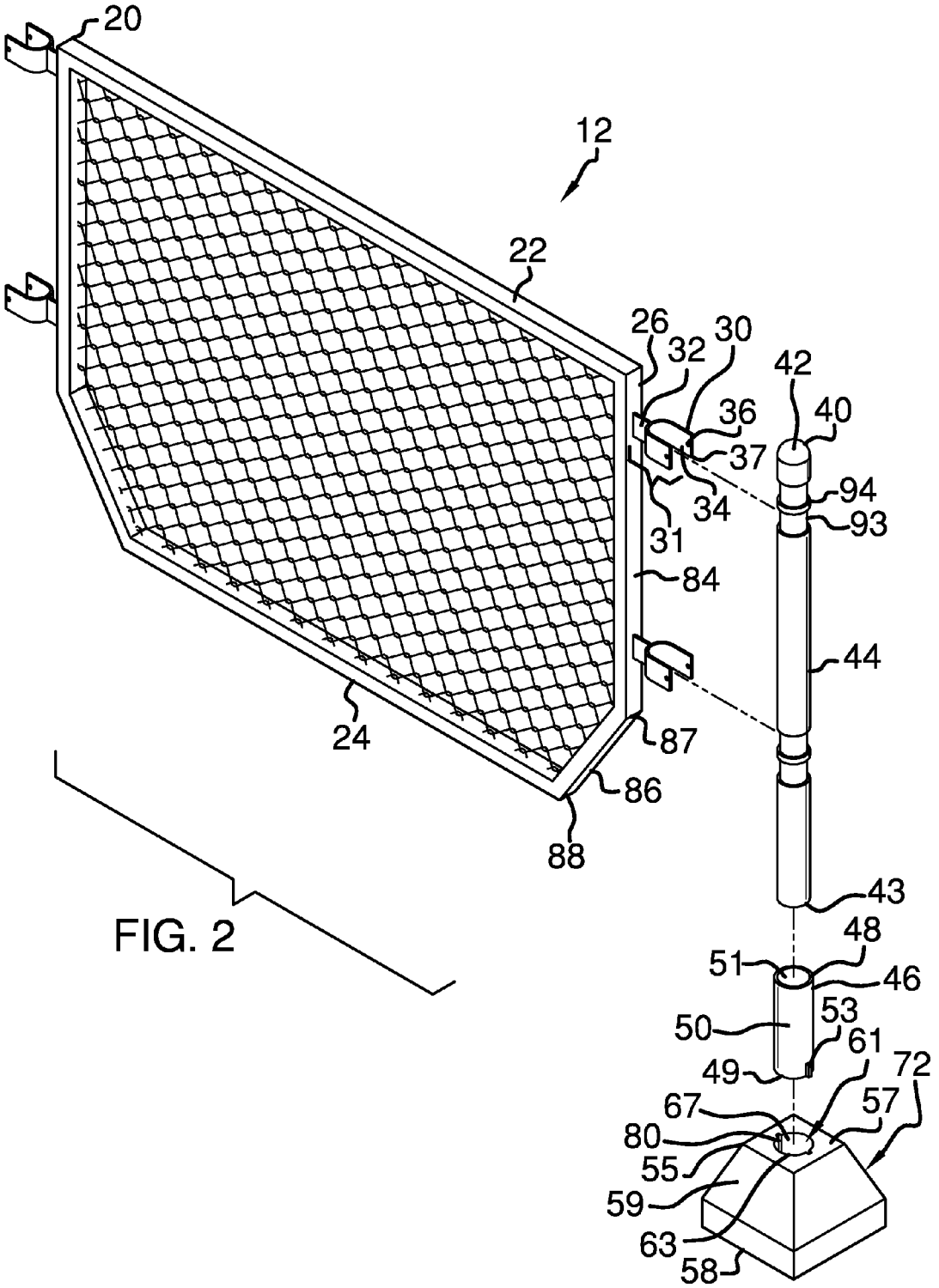
FIG. 2 is an exploded isometric view showing assembly.
Figure 3:
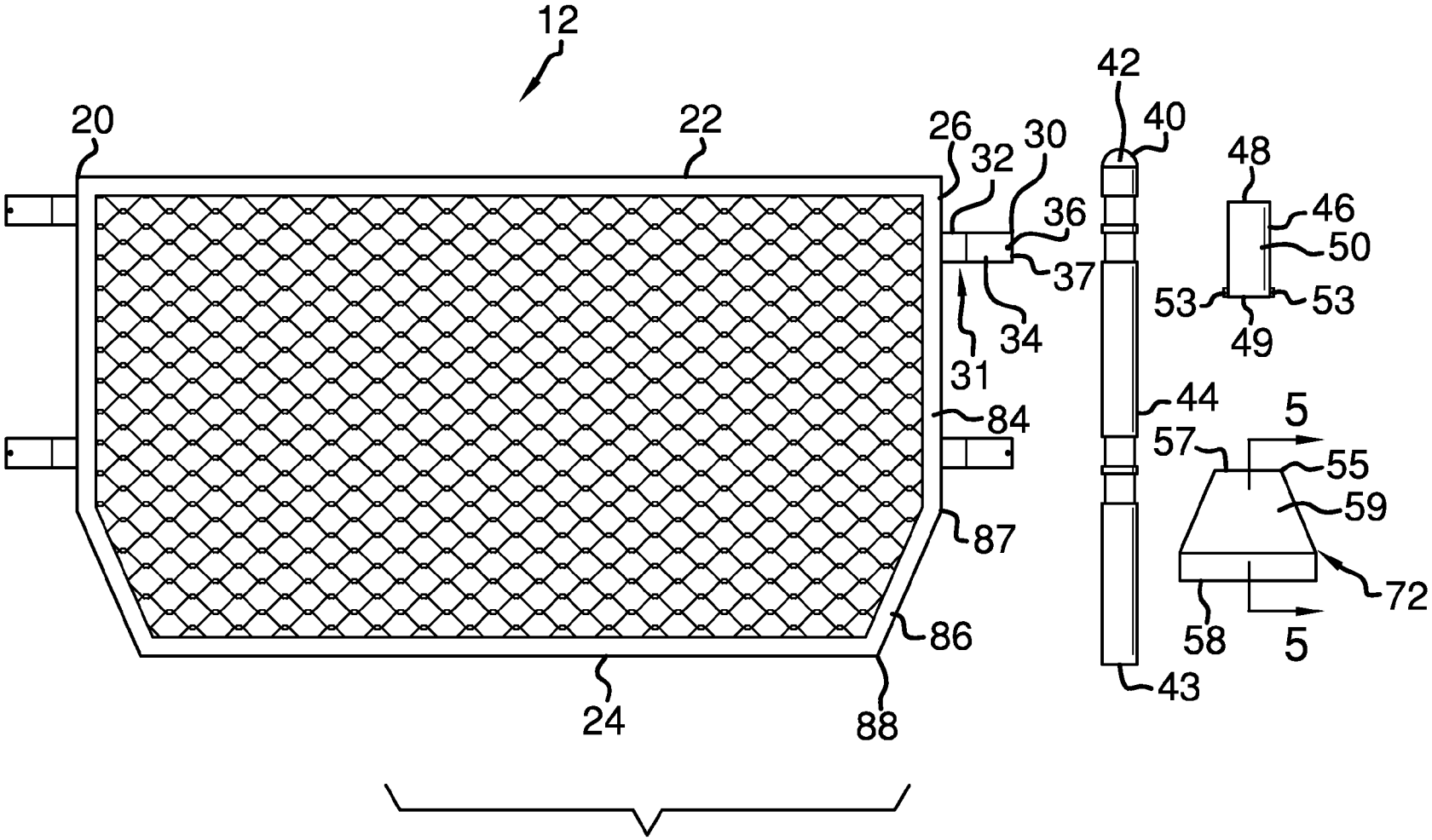
FIG. 3 is a front elevation view of a first fencing panel, a fence pole, a host sleeve, and a first base body as shown from left to right and top to bottom.
Figure 4:
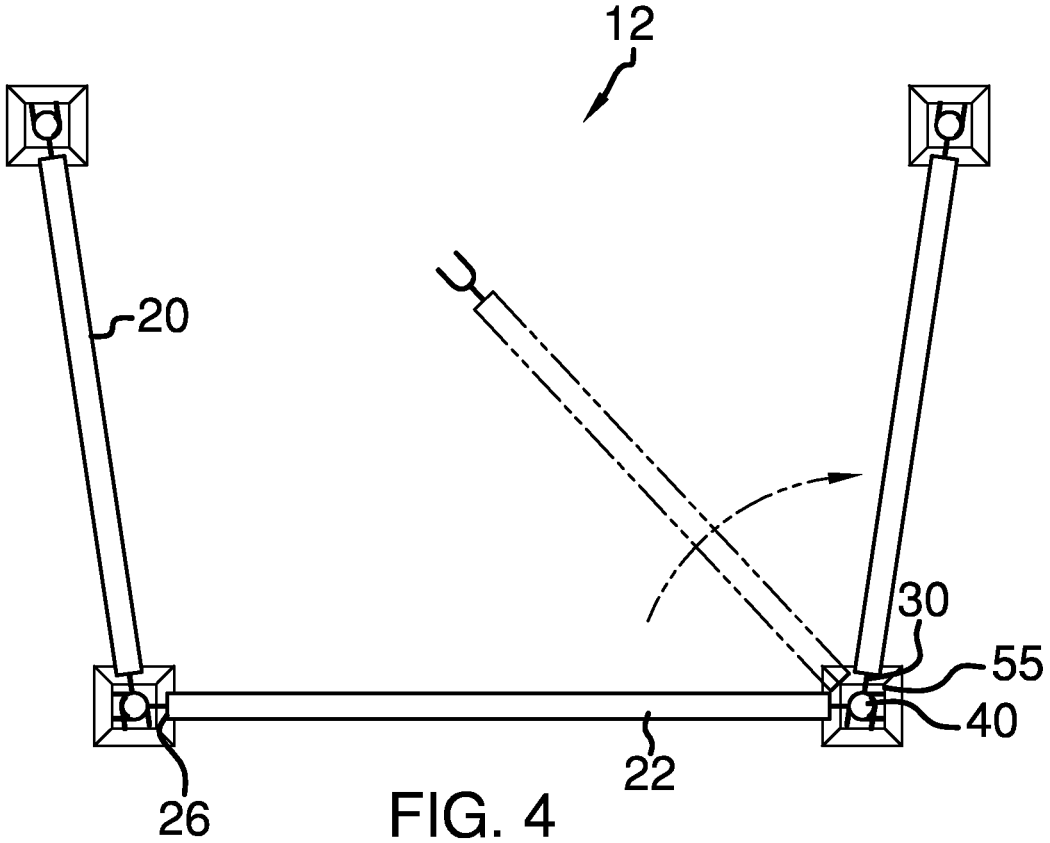
FIG. 4 is a top plan view illustrating the rotatability of a fencing panel relative to a fence pole.
Figure 5:
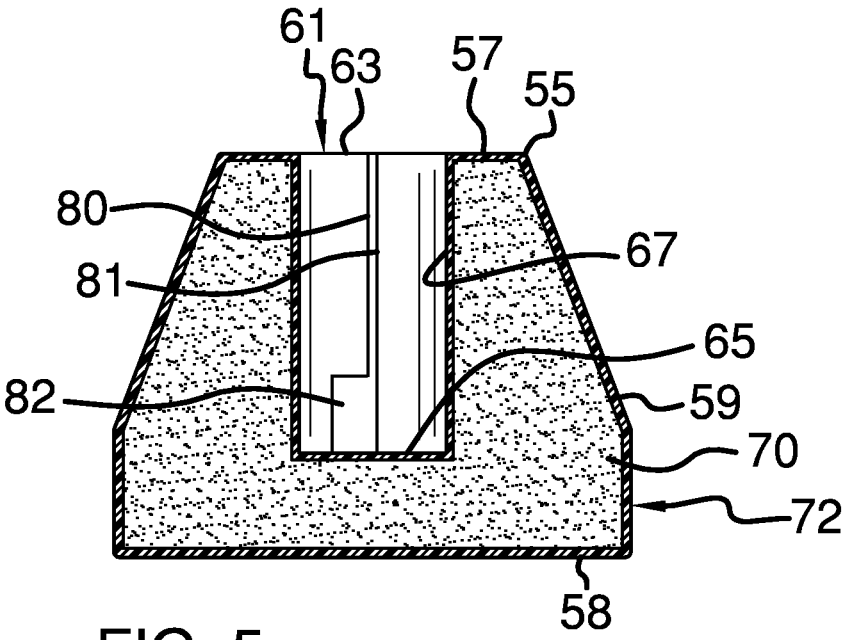
FIG. 5 is a cross-sectional view of a first base body as taken along line 5-5 of FIG. 3.

As best shown in FIG. 2, the external surface 44 of each first fence pole 45 has a first circumference and at least one vertical indent 93 having a second circumference which is smaller than the first circumference. A continuous rail end band 94, being the same circumference as the first circumference, is centrally disposed along the second circumference. One of the clamps 30 is attachable to the second circumference of at least one the vertical indents 93. Upon the attachment of at least one of the clamps 30 to the second circumference of a respective one of the vertical indents 93, the fencing panel 20 is attached to the respective first fence pole 45.

Figure 8A:
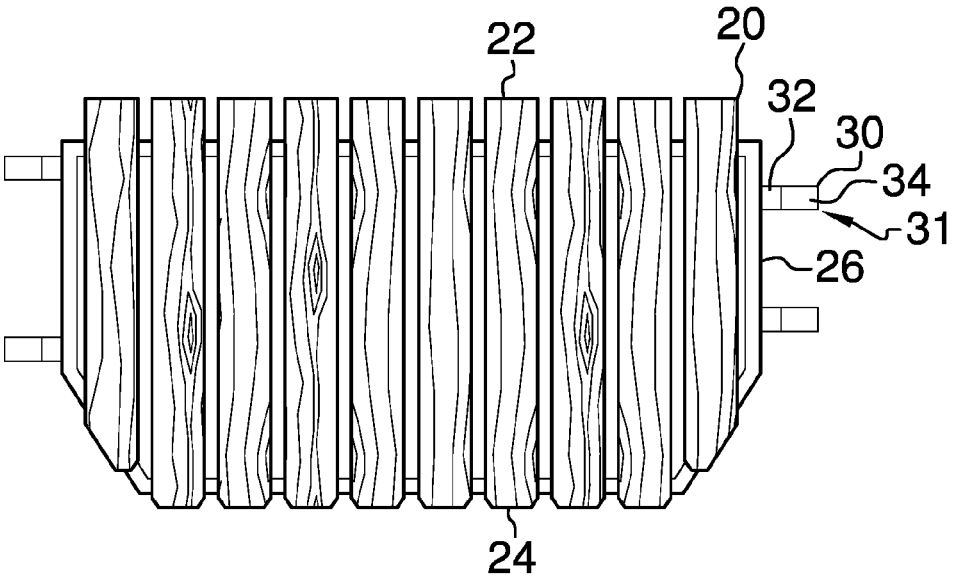
FIG. 8A is a front elevation view of a first fencing panel shown as a clapboard fencing panel.
Figure 8B:
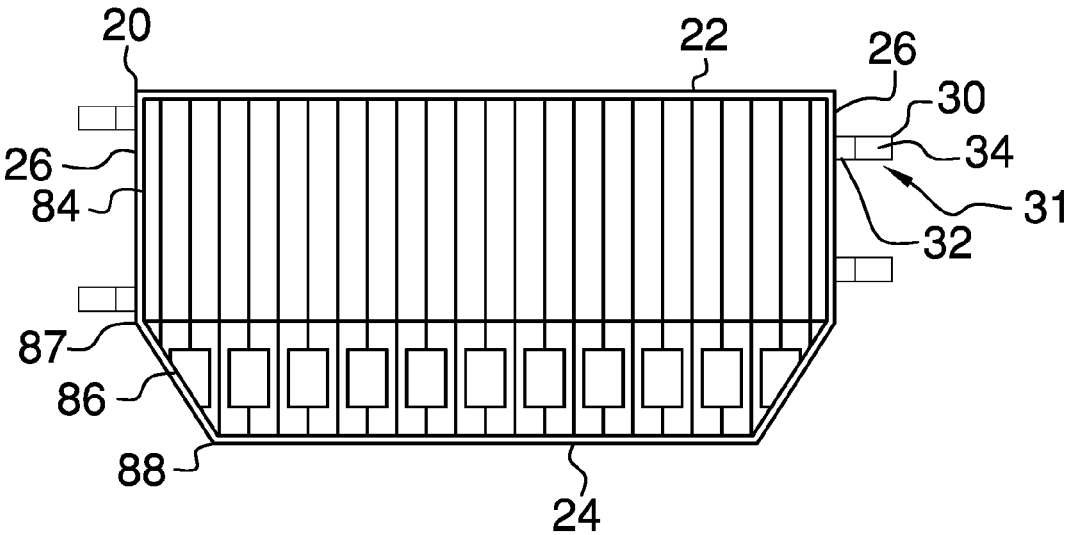
FIG. 8B is a front elevation view of a first fencing panel shown as a wrought iron type fencing panel.
Figure 9:
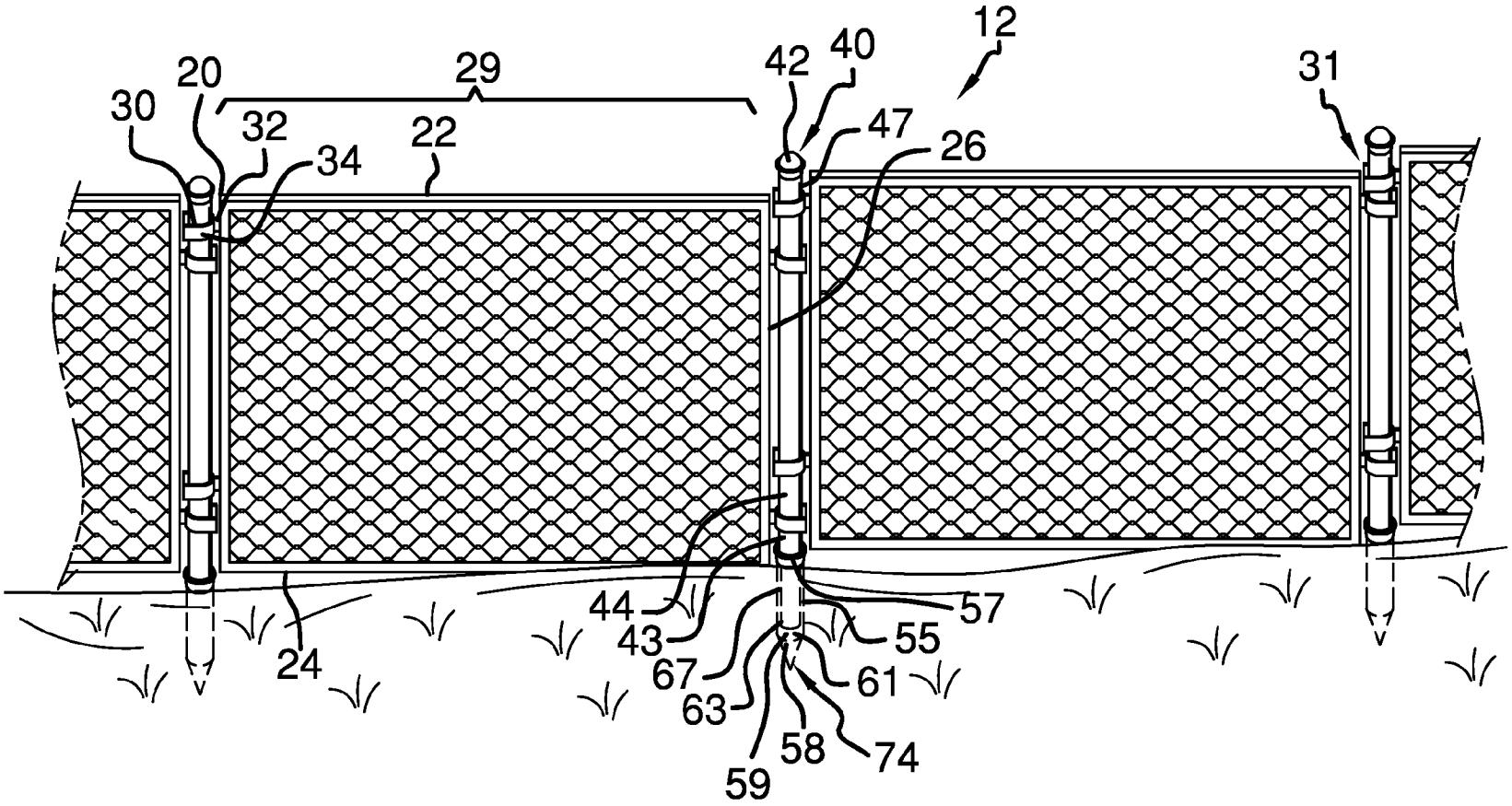
FIG. 9 is a front elevation of a plurality of second fencing panels, in the form of a chain-link fencing panel, connected together with a plurality of fence poles which, in turn, are attached to a plurality of second base bodies.
Figure 10:
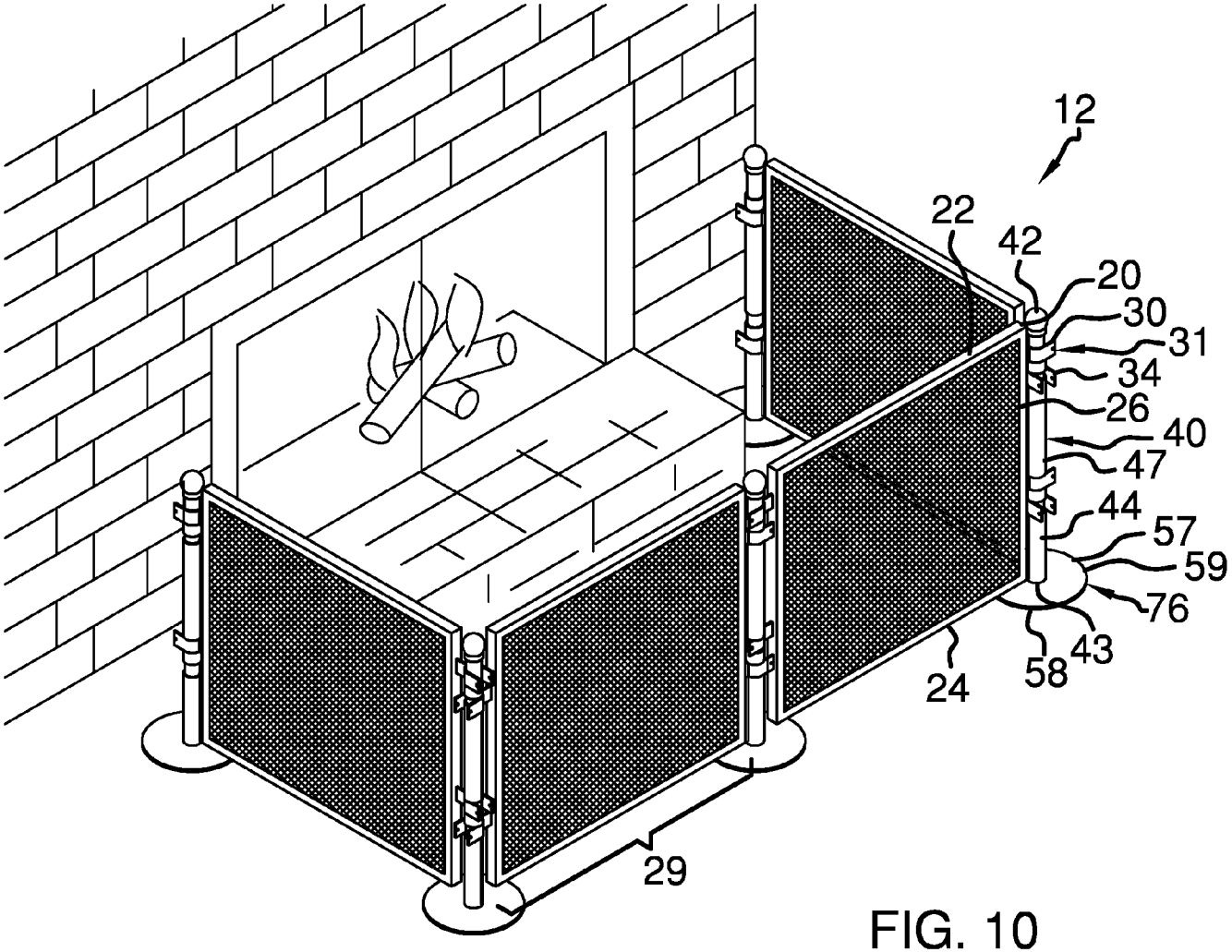
FIG. 10 is a front elevation of a plurality of second fencing panels, in the form of a mesh fencing panel, connected together with a plurality of fence poles which, in turn, are attached to a plurality of third base bodies.

Each of the fencing panels 40 is one of a chain-link fencing panel as shown in FIG. 1, a clapboard fencing panel as shown in FIG. 8, a wrought iron type fencing panel as also shown in FIG. 8, and a mesh fence as shown in FIG. 10.

Figure 6:
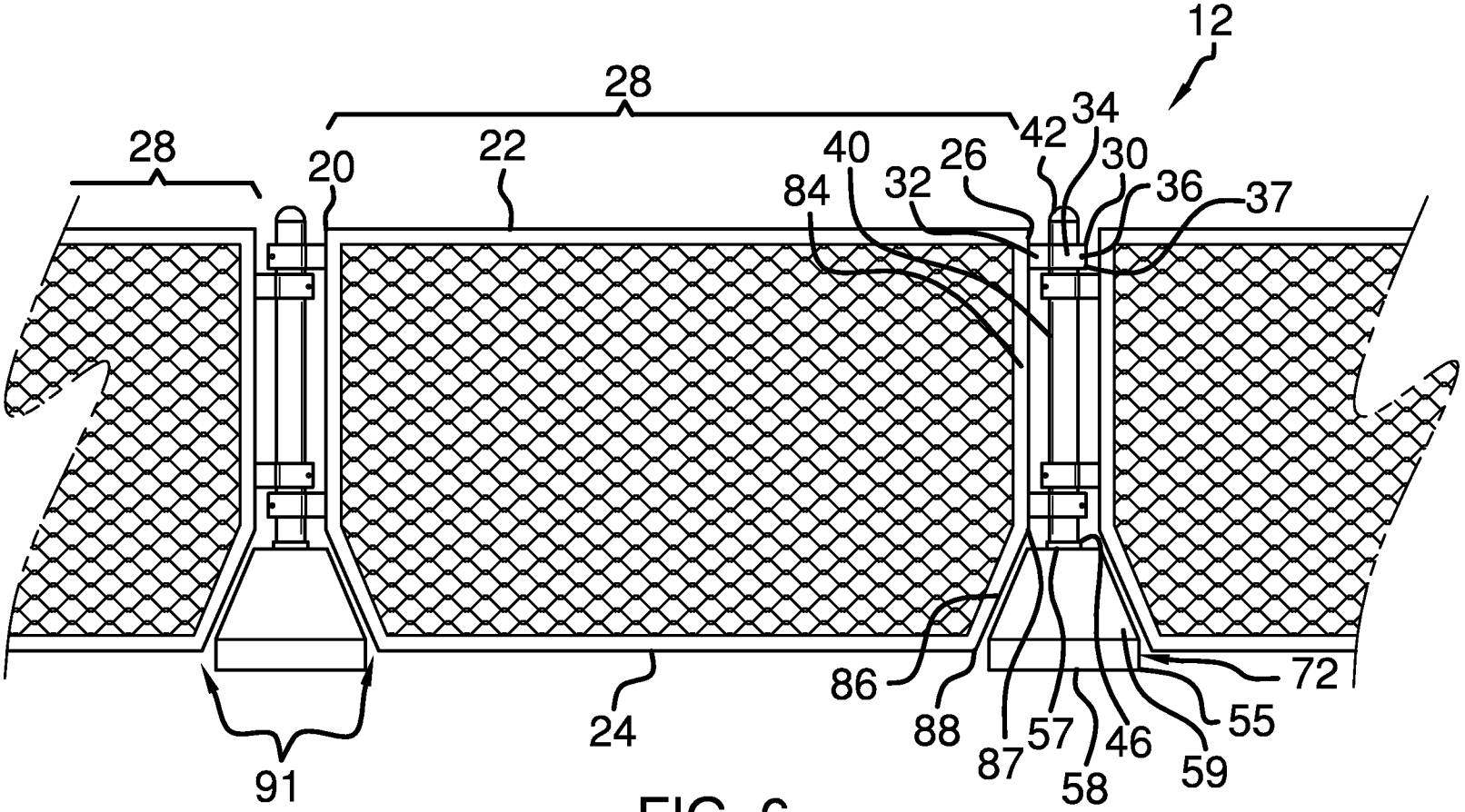
FIG. 6 is a detail view showing a plurality of the first fencing panels conjoined together with a plurality of the fence poles supported by first base bodies.
Figure 7:
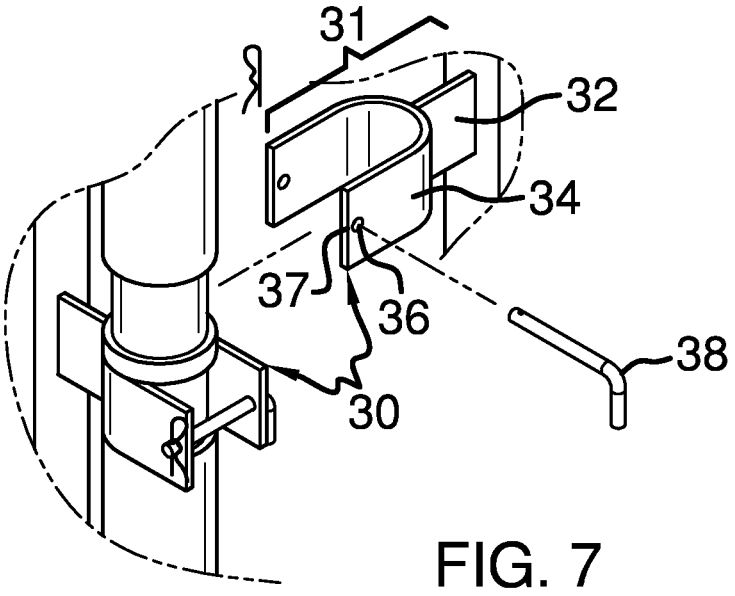
FIG. 7 is a detail view showing a pair of fasteners, in the form of clamps, attached to a fence pole at a corner juncture of a pair of fencing panels.

As one example of usage of the present kit 10, which is shown in FIG. 6, after determining a location of placement, a user inserts one of the host sleeves 46 into each of a pair of the first base bodies 72, which can be separated at lengths that match the length of a first fencing panel 28. The user then attaches a fence pole 40 to each of the clamps 30 and then inserts the fence poles 40 into the host sleeves 46. The user can then pre-place an additional one of the first base bodies 72 at a panel-length away from the first base body 72 to which the fence pole 40 has been attached and insert a host sleeve 46 into the pre-placed first base body 72. The user can then attach a fence pole 40 to the sidewall 26 of another one of the first fencing panels 28, affix the opposite sidewall 26 thereof to a respective fence pole 40 of the first fencing panel 28 that has already been attached to the first base body 72, and then insert the respective fence pole 40 into the respective host sleeve 46 of the pre-placed first base body 72. During installation, the user can swivel the first fencing panels 28 to form a desired configuration of fence, such as triangular or rectangular. To disassemble the fence, the user lifts the first fencing panels 28 from the respective host sleeves 46, removes the host sleeves 46 for the respective first base bodies 72, and removes the fence poles 40 from the first fencing panels 28, thus allowing the individual components of the fence to be stored or moved to another location.

What is claimed is:

1. A modular fence kit comprising:

at least one pre-formed fencing panel, each fencing panel having a top end, a bottom end, and a pair of sidewalls opposite each other between the top end and the bottom end, wherein each fencing panel is one of a first fencing panel and a second fencing panel;

each first fencing panel comprising:

the bottom end having shorter length than a length of the top end and being centrally disposed relative the top end;

each of the sidewalls having a vertical top portion perpendicular to the top end and an inwardly angled bottom portion, wherein the bottom portion is angled from a bottommost end of the vertical top portion toward a respective outer end of the bottom end;

a gap disposed between the bottom portions of each of a pair of the adjoining first fencing panels;

each second fencing panel comprising:

the bottom end having a same width as a length of the top end;

wherein each of the sidewalls is perpendicular to each of the top and bottom ends;

at least one pair of fence poles, each fence pole having an uppermost end, a lowermost end, and a continuous external surface between the uppermost end and the lowermost end;

at least one fastener attaching each sidewall of the respective fencing panel to one of the respective fence poles;

a pair of protrusions vertically disposed on opposite sides of the outside wall of each host sleeve proximal the lower end thereof;

a plurality of bases, wherein the bases comprise a first base body, a second base body, and a third base body, each base having a top wall, a bottom wall, and a continuous exterior wall disposed therebetween;

at least one pair of host sleeves provided for each pair of the first base bodies, each host sleeve having an upper end, a lower end, continuous outside wall therebetween, and a continuous channel between the upper end, the lower end, and the outside wall, wherein the lowermost end of each fence pole rotatably engages the channel of a respective one of the host sleeves;

a vertical cavity centrally disposed in each of the first base body and the second base body, the cavity having an open top side contiguous with the top wall of the base, a closed bottom side proximal the bottom wall of the base, and a continuous external wall disposed therebetween;

wherein one of the host sleeves engages the vertical cavity of each of a respective one of the first base bodies;

an amount of fill material disposed within each first base body between the top wall, the bottom wall, the exterior wall, and the vertical cavity; and a pair of vertical slots disposed within opposite sides of the external wall of the vertical cavity of each first base body, each vertical slot having an upper portion and a lower portion disposed proximal the bottom side of the vertical cavity of each first base body, wherein the lower portion has a wider width than the upper portion;

wherein each protrusion on the host sleeve slidingly engages the upper portion of the vertical slot and lockingly engages the lower portion of the vertical slot in a locked position, wherein upon placement of the protrusions in the locked position, the host sleeve is locked into the respective first base body;

wherein the protrusions can be placed into the locked position and alternately into an unlocked position;

wherein a portion of the exterior wall of each first base body having a same angle as the bottom portion; and wherein the angle of the portion of the exterior wall of each first base body and a width and a height of each first base body base substantially fills the respective gap between each of the pair of adjoining first fencing panels.

2. The modular fence kit of claim 1 further comprising:

a first circumference of the external surface of each first fence pole;

at least one vertical indent continuously disposed in the external surface of each first fence pole, each vertical indent having a second circumference, wherein the second circumference is smaller than the first circumference;

a continuous rail end band centrally disposed along the second circumference, each rail end band being the same as the first circumference;

wherein one of the fasteners is attachable to the second circumference of at least one the vertical indents;

wherein upon the attachment of at least one of the fasteners to the second circumference of the at least one vertical indent, the fencing panel is attached to the respective first fence pole.

3. The modular fence kit of claim 2 wherein each of the fencing panels is one of a chain-link fencing panel, a clapboard fencing pane, a wrought iron type fencing panel, and a mesh fence.

4. The modular fence kit of claim 2 wherein the fastener is a clamp disposed on each sidewall of the respective fencing panel, each clamp having an arm perpendicularly attached to the respective sidewall, a U-shaped mount body attached to the arm, and a pair of aligned holes disposed proximal an external edge of the mount body; and a clevis pin lockingly engaging the aligned holes of one of each of the respective clamps;

wherein one of each of the fence poles rotatably engages a respective one of the clamps.

5. The modular fence kit of claim 1 wherein the second base body is a hollow stake having an inverted conical end and a pointed tip.

6. The modular fence kit of claim 5 wherein each of the fencing panels is one of a chain-link fencing panel, a clapboard fencing panel, a wrought iron type fencing panel, and a mesh fence.

7. The modular fence kit of claim 1 wherein the third base body is a disc.

8. The modular fence kit of claim 7 wherein each of the fencing panels is one of a chain-link fencing panel, a clapboard fencing panel, a wrought iron type fencing panel, and a mesh fence.

9. The modular fence kit of claim 1 wherein the fastener is a clamp disposed on each sidewall of the respective fencing panel, each clamp having an arm perpendicularly attached to the respective sidewall, a U-shaped mount body attached to the arm, and a pair of aligned holes disposed proximal an external edge of the mount body; and a clevis pin lockingly engaging the aligned holes of one of each of the respective clamps;

wherein one of each of the fence poles rotatably engages a respective one of the clamps.

10. The modular fence kit of claim 1 wherein each of the fencing panels is one of a chain-link fencing panel, a clapboard fencing panel, a wrought iron type fencing panel, and a mesh fence.

11. A modular fence kit comprising:

at least one pre-formed fencing panel, each fencing panel having a top end, a bottom end, and a pair of sidewalls opposite each other between the top end and the bottom end, wherein each fencing panel is one of a first fencing panel and a second fencing panel;

each first fencing panel comprising:

the bottom end having shorter length than a length of the top end and being centrally disposed relative the top end;

each of the sidewalls having a vertical top portion perpendicular to the top end and an inwardly angled bottom portion, wherein the bottom portion is angled from a bottommost end of the vertical top portion toward a respective outer end of the bottom end;

a gap disposed between the bottom portions of each of a pair of the adjoining first fencing panels;

each second fencing panel comprising:

the bottom end having a same width as a length of the top end;

wherein each of the sidewalls is perpendicular to each of the top and bottom ends;

at least one pair of fence poles, each fence pole having an uppermost end, a lowermost end, and a continuous external surface between the uppermost end and the lowermost end;

at least one fastener attaching each sidewall of the respective fencing panel to one of the respective fence poles;

a pair of protrusions vertically disposed on opposite sides of the outside wall of each host sleeve proximal the lower end thereof;

a plurality of bases, wherein the bases comprise a first base body, a second base body, and a third base body, each base having a top wall, a bottom wall, and a continuous exterior wall disposed therebetween, wherein the second base body is a hollow stake having an inverted conical end and a pointed tip, wherein the third base body is a disc;

at least one pair of host sleeves provided for each pair of the first base bodies, each host sleeve having an upper end, a lower end, continuous outside wall therebetween, and a continuous channel between the upper end, the lower end, and the outside wall, wherein the lowermost end of each fence pole rotatably engages the channel of a respective one of the host sleeves;

a vertical cavity centrally disposed in each of the first base body and the second base body, the cavity having an open top side contiguous with the top wall of the base, a closed bottom side proximal the bottom wall of the base, and a continuous external wall disposed therebetween;

wherein one of the host sleeves engages the vertical cavity of each of a respective one of the first base bodies;

an amount of fill material disposed within each first base body between the top wall, the bottom wall, the exterior wall, and the vertical cavity; and a pair of vertical slots disposed within opposite sides of the external wall of the vertical cavity of each first base body, each vertical slot having an upper portion and a lower portion disposed proximal the bottom side of the vertical cavity of each first base body, wherein the lower portion has a wider width than the upper portion;

a first circumference of the external surface of each first fence pole;

at least one vertical indent continuously disposed in the external surface of each first fence pole, each vertical indent having a second circumference, wherein the second circumference is smaller than the first circumference;

a continuous rail end band centrally disposed along the second circumference, each rail end band being the same as the first circumference;

wherein one of the fasteners is attachable to the second circumference of at least one the vertical indents;

wherein upon the attachment of at least one of the fasteners to the second circumference of the at least one vertical indent, the fencing panel is attached to the respective first fence pole;

wherein each protrusion on the host sleeve slidingly engages the upper portion of the vertical slot and lockingly engages the lower portion of the vertical slot in a locked position, wherein upon placement of the protrusions in the locked position, the host sleeve is locked into the respective first base body;

wherein the protrusions can be placed into the locked position and alternately into an unlocked position;

wherein a portion of the exterior wall of each first base body having a same angle as the bottom portion; and wherein the angle of the portion of the exterior wall of each first base body and a width and a height of each first base body base substantially fills the respective gap between each of the pair of adjoining first fencing panels.

12. The modular fence kit of claim 11 wherein the fastener is a clamp disposed on each sidewall of the respective fencing panel, each clamp having an arm perpendicularly attached to the respective sidewall, a U-shaped mount body attached to the arm, and a pair of aligned holes disposed proximal an external edge of the mount body; and a clevis pin lockingly engaging the aligned holes of one of each of the respective clamps;

wherein one of each of the fence poles rotatably engages a respective one of the clamps.

13. The modular fence kit of claim 12 wherein each of the fencing panels is one of a chain-link fencing panel, a clapboard fencing panel, a wrought iron type fencing panel, and a mesh fence.

* * * * *